United States Patent [19]

Erb et al.

[11] Patent Number: 4,853,070

[45] Date of Patent: Aug. 1, 1989

[54] APPARATUS FOR MAKING MULTIPLE HOOK FASTENER MEDIA

[75] Inventors: George H. Erb, Cuttingsville; Susan E. Beard, Rutland, both of Vt.

[73] Assignee: Erblok Associates, Charlottesville, Va.

[21] Appl. No.: 273,743

[22] Filed: Nov. 15, 1988

Related U.S. Application Data

[63] Continuation of Ser. No. 186,671, Apr. 20, 1988, abandoned, which is a continuation of Ser. No. 945,208, Dec. 19, 1986, abandoned, which is a continuation of Ser. No. 827,663, Feb. 7, 1986, abandoned, which is a continuation of Ser. No. 642,999, Aug. 21, 1984, abandoned.

[51] Int. Cl.[4] ..... B32B 5/02; A44B 18/00

[52] U.S. Cl. ..... 156/436; 156/580.1; 425/370; 425/391; 425/392; 425/394; 425/505

[58] Field of Search ..... 156/66, 72, 73.2, 161, 156/166, 176, 178, 205, 210, 433, 435, 436, 443, 461, 462, 580.1; 24/442, 448, 450, 452; 264/243, 280, 285, 287, 295, 296; 425/391, 392, 394, 396

[56] References Cited

U.S. PATENT DOCUMENTS

| | | | |
|---|---|---|---|
| 3,147,528 | 9/1964 | Erb | 24/204 |
| 3,196,490 | 7/1965 | Erb | 18/21 |
| 3,255,288 | 6/1966 | Steingruednen | 425/391 |
| 3,405,430 | 10/1968 | Sidelman | 24/450 |
| 3,527,629 | 9/1970 | Wylde | 156/72 |
| 3,542,911 | 11/1970 | Porepp | 264/285 |
| 3,546,754 | 12/1970 | Erb | 24/204 |
| 3,550,223 | 12/1970 | Erb | 24/204 |
| 3,550,837 | 12/1970 | Erb | 229/45 |
| 3,562,044 | 2/1971 | Erb | 156/155 |
| 3,562,770 | 2/1971 | Erb | 24/204 |
| 3,586,060 | 6/1971 | Erb | 139/46 |
| 3,594,863 | 7/1971 | Erb | 18/5 |

(List continued on next page.)

FOREIGN PATENT DOCUMENTS

| | | | |
|---|---|---|---|
| 0669722 | 9/1963 | Canada | 29/12 |

*Primary Examiner*—Michael W. Ball
*Assistant Examiner*—Steven D. Maki
*Attorney, Agent, or Firm*—Parmelee, Bollinger & Bramblett

[57] ABSTRACT

Apparatus for making multiple hook-fastener media in which many protruding hooks are formed at relatively high speed from suitable bendable and settable plastic material which may be different from the substrate to which these pre-formed hooks are subsequently bonded. Many rows of hooks are formed simultaneously, each row from a strand, for example, a monofilament of longitudinally oriented polymeric material. The formed strands are "set" into their multiple hook row configuration, and then these pre-formed rows of hooks are simultaneously bonded to the substrate. Thus, an attractive substrate of any reasonable width, for example, of three inches, six inches, a foot or a yard, may be used. The production apparatus enables the number of hooks per square inch, either longitudinally or laterally or both, to be adjusted while running. The shank of each hook includes two legs, and the production apparatus can be adjusted while running for making hooks with crossed legs, uncrossed legs or divergent legs for achieving varieties of configurations and characteristics, as desired for various applications. Advantageously, the production can be changed for making taller or shorter hooks and for making hooks with differently shaped arcuate ends by exchanging one pair of meshing (interdigitating) shaping belts for another. The substrate material may be woven or non-woven and may comprise multiple layers including metal or plastic layers or both. The substrate with mounted hooks can be slit longitudinally for producing many hook-fastener tapes at relatively fast overall lineal speed. Consequently, the hook-fastener media of this invention with their various sizes, shapes, widths and characteristics, fabricated by relatively low-cost, high-speed production hold promise of becoming widely available, widely used, commodity-type products which will find their way into myriads of applications of benefit to human beings in years to come.

22 Claims, 6 Drawing Sheets

U.S. PATENT DOCUMENTS

| | | | |
|---|---|---|---|
| 3,594,865 | 7/1971 | Erb | 18/5 |
| 3,595,059 | 7/1971 | Erb | 72/362 |
| 3,629,032 | 12/1971 | Erb | 156/196 |
| 3,665,584 | 5/1972 | Erb | 29/410 |
| 3,695,976 | 10/1972 | Erb | 156/435 |
| 3,708,382 | 1/1973 | Erb | 161/48 |
| 3,715,415 | 2/1973 | Erb | 204/25 |
| 3,718,725 | 2/1973 | Hamane | 264/296 |
| 3,732,604 | 5/1973 | Erb | 28/76 |
| 3,735,468 | 5/1973 | Erb | 29/207 |
| 3,781,398 | 12/1973 | Erb | 264/146 |
| 3,801,245 | 4/1974 | Erb | 425/174.4 |
| 3,897,192 | 7/1975 | Heimberger | 425/391 |
| 3,951,716 | 4/1976 | Takamatsu | 156/73.2 |
| 4,290,832 | 9/1981 | Kallebes | 24/448 |
| 4,333,903 | 6/1982 | Yoshida et al. | 264/285 |
| 4,502,902 | 3/1985 | Zurche et al. | 156/73.2 |
| 4,615,084 | 10/1986 | Erb | 156/66 |

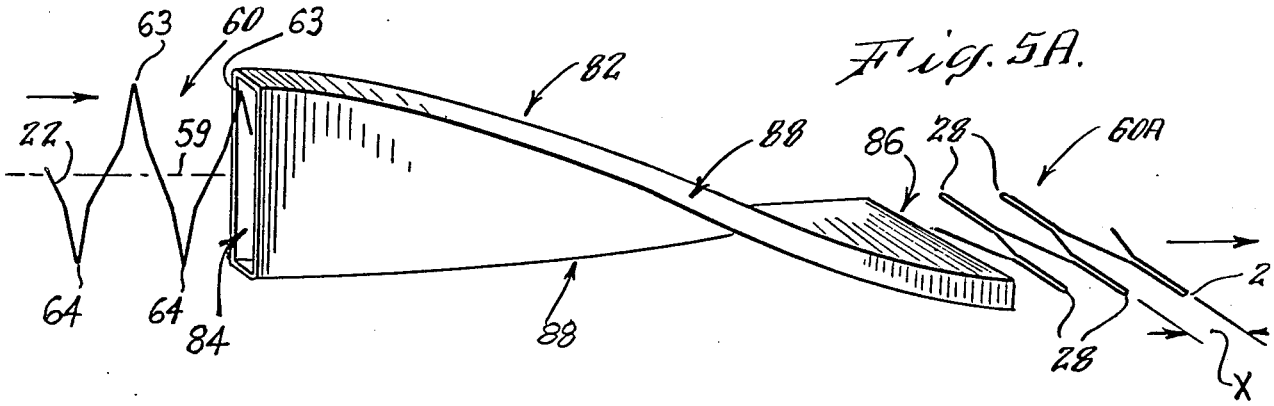
Fig. 5A.
Fig. 5B.
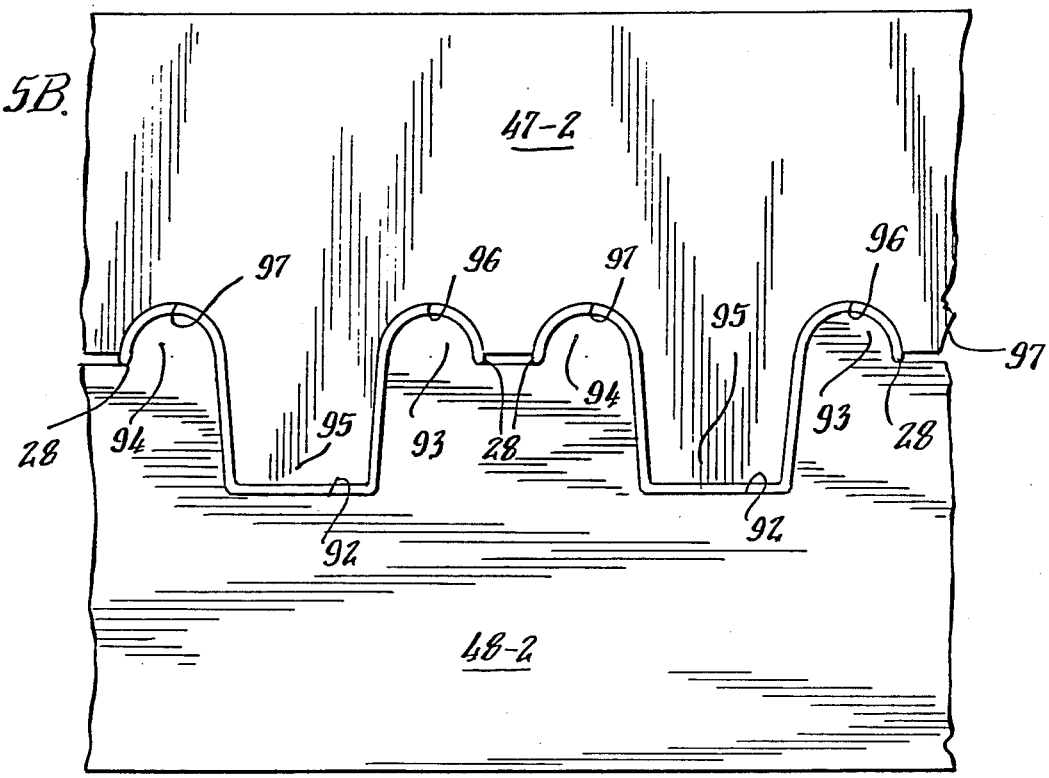
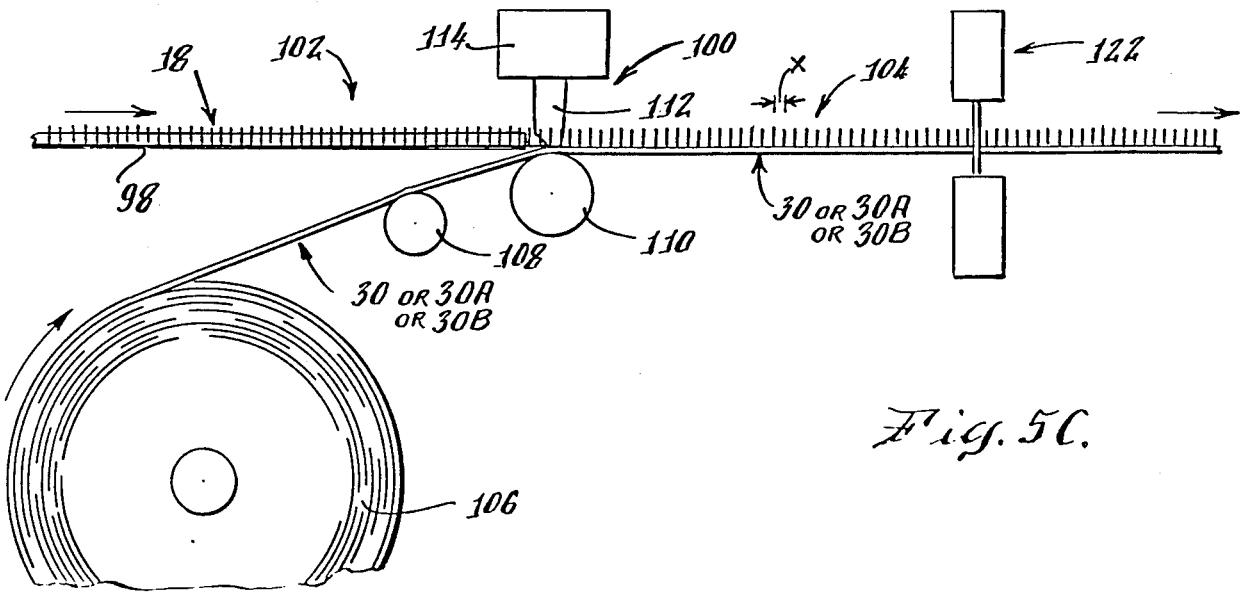
Fig. 5C.

APPARATUS FOR MAKING MULTIPLE HOOK FASTENER MEDIA

This a continuation application of Ser. No. 186,671, filed Apr. 20, 1988; which was a continuation of Ser. No. 945,208, filed Dec. 19, 1986; which was a continuation of Ser. No. 827,663, filed Feb. 7, 1986 which was a continuation of patent application Ser. No. 642,999, filed Aug. 21, 1984 all abandoned.

FIELD OF THE INVENTION

This invention is in the field of hook and loop fasteners, and more specifically the invention relates to the hook-fastener medium for providing hook-like gripping engagement with an opposed area containing multiple accessible loops or fibers forming multiple accessible apertures. The hook-fastener medium contains multiple small hooks protruding from one face. This hook-fastener medium is brought into contact with a second fastener area containing multiple loops or multiple fibers forming loop-like apertures, herein called the "loop medium". The hooks become engaged in hook-like fashion with the loops or loop-like apertures of the loop medium for attaching the hook-fastener medium to the loop medium. Subsequently, if desired, the hook-fastener medium can be separated from the loop medium by forcefully pulling them apart, and often such forceful separation is most easily achieved by a "peeling" action. Such hook and loop fasteners are usually intended to be capable of being separated and refastened together at least several times during their lifetime.

BACKGROUND OF THE INVENTION

There exist in the marketplace today a number of different hook-fastener media to be described below. It is our belief that each of these existing hook-fasteners suffers from one or more shortcomings which hamper their utility and utilization.

2 Woven hook-fastener medium

The original hook-fastener medium is fabricated by a needle loom, and it is currently made as a tape approximately one to four inches wide having a selvage along each margin of the tape, the tape has a woven substrate with an oriented monofilament woven by the loom into the substrate while the substrate itself is being woven This monofilament is woven with periodic protruding loops which are thereafter heat set and subsequently picked up in the loom or in a secondary machine by small needles. Associated with these small needles are small cutters which serve to cut each loop at a cutting position which is oriented between 3 o'clock and 4 o'clock. Each cut loop thus forms a protruding hook, but there remains a stub of each cut loop standing closely adjacent to the tip of the hook.

One of the shortcomings of this woven hook-fastener medium is that the loops are not always cut, and the stubs which remain near the cut tips of the hooks interfere with and prevent the desired hooking engagement with an opposed loop medium. Consequently, a significant number of the hooks do not engage into the loops or apertures. In other words, the hooking efficiency is reduced by the presence of the stubs and uncut loops.

A second shortcoming of the woven hook-fastener medium results from the fact that any given needle loom can produce only one size of cut hooks. The cut hooks are always formed of monofilaments of the same characteristics and same denier, and the tape is always of the same width. In other words, there is no possibility of adjusting the loom for producing different widths of tapes or different sizes of cut hooks or different spaces between the hooks or different characteristics of the hooks such as different resilience or different hooking strengths. In summary, the loom can slowly produce only one product.

A third shortcoming of this woven hook-fastener medium results from the fact that the woven-in monofilaments which form the cut hooks must be bonded into the woven substrate for preventing their extraction from the substrate whenever the hook medium is forcefully separated from a loop medium by pulling them apart The lower surface of the woven substrate is coated with a tacky bonding agent. Then, this bonding agent is cured for permanently anchoring the cut hooks into the woven substrate. This bonding agent causes the lower surface of the woven substrate to have a glazed appearance. The woven tape as a whole has an unattractive stiffness and has an unattractive "feel" as compared with ordinary woven fabric tapes.

The fourth and most important shortcoming of the woven hook-fastener medium is its relatively great expense, caused by the slow speed at which the tape can be woven in a needle loom. Such needle looms are very complex, with many intricate small parts. Increasing the width of the woven tape slows the lineal production speed, because increasing the width of the loom inherently slows down its lineal production speed, thus increasing the cost per unit length. The relatively high cost of the woven hook-fastener medium has restricted and limited its commercial applications, for example, to closures for expensive clothing and sporting shoes, closures for watch bands, and the like.

2. Molded hook-fastener media

During the time period from early 1961 to mid 1972one of the present inventors was previously active in this hook and loop fastener field, as shown by U.S. Pat. Nos.

| | | |
|---|---|---|
| 3,147,527 | 3,586,060 | 3,708,382 |
| 3,196,490 | 3,594,863 | 3,715,415 |
| 3,546,754 | 3,594,865 | 3,732,604 |
| 3,550,223 | 3,595,059 | 3,735,468 |
| 3,550,837 | 3,629,032 | 3,781,398 |
| 3,562,044 | 3,665,584 | 3,801,245 |
| 3,562,770 | 3,695,976 | |

In order to increase the production speed for making hook-fastener media beyond the speed which is possible for the woven type as described under section 1 above, one of the present inventors conceived and developed a molded hook-fastener. The hooks are molded of plastic material integral with a substrate layer. Thus the lineal production speed of the substrate with the hooks protruding can be considerably increased, as compared with the operation of the slow-speed, intricate needle loom.

Some molding machines of said inventor were subsequently modified to produce a double-hook having two hook-shaped heads on each single shank. These hook-shaped heads are located on opposite sides of the shank, i.e. they are angularly spaced 180° about the longitudinal axis of the shank, similar to the double-hook on the shank of an anchor from an old sailing vessel. Such a molded double-hook-fastener medium has a strong gripping effect on the loop medium. It is difficult to separate them. If sufficient pulling, peeling force is applied to separate the molded double-hook-fastener from the loop medium, many of the loops become broken or torn apart. Thus, the molded double-hook-fastener medium is best suited to permanent industrial-type attachments.

One shortcoming of these molded hook-fastener media results from the fact that the hooks must be molded of a relatively stiff plastic material in order for them to have sufficient strength to provide the desired hook-like gripping engagement with the loop medium. Since the hooks are molded integral with the substrate tape, this tape itself has a relatively stiff rigidity, which makes the molded hook-fastener media unsuitable or unattractive for use in visible locations or as closures on clothing. Thus, the molded hook-fastener media, whether single-hook or double-hook, are limited to industrial-type uses in hidden locations, for example, to secure floor pads in place in vehicles.

Another shortcoming of the molded hook-fastener media is the expense of replacing the molding plates of the molding machine to change the size or characteristics of the hooks. Also, a relatively narrow tape is produced, and its width cannot be adjusted, so it produces only one product, but it is very considerably faster than the original needle loom.

3 Molded mushroom-hook-fastener medium

A variation of the molded single-hook or double-hook fastener media is to form a mushroom-shaped head on the protuding shank of the hook. Such mushroom heads can be molded onto each shank in the first instance. Alternatively, the outer end of each shank can be "upset" by heat and pressure in order to forge the mushroom heads on the shanks.

Such a molded mushroom-hook-fastener medium has a strong gripping effect on the loop medium, and they are difficult to separate. When sufficient pulling, peeling force is applied to separate these fasteners, numbers of the mushroom heads become snapped off of their shanks or the shanks are snapped off at their roots. Therefore, mushroom fasteners are best suited to permanent industrial-type attachments.

In summary, all three molded-type hook fasteners (single-hook, double-hook, or mushroom head) suffer from the disadvantage that the substrate must be molded from the same material as the hooks. It is not possible, up to the present time, to make the substrate of attractive, desirable, compliant material different from the stiff, plastic material used to mold the hooks.

SUMMARY OF THE PRESENT INVENTION

In accordance with the present invention, the protruding hooks can be formed of a different material from the substrate and then are bonded onto the precoated substrate. Thus, a very desirable and attractive material can be used to make the substrate. The substrate may be of any reasonable width: for example, three inches wide, six inches wide, a foot wide, a yard wide.

The production apparatus of this invention enables the number of hooks per square inch to be adjusted while running, i.e., the hook concentration or density per unit length can be varied, as desired for various products and for various fastener applications.

In addition, while running, the production apparatus can be adjusted for making hooks with crossed legs or with uncrossed legs or with divergent legs, because the shank portion of each hook includes two legs.

Advantageously, the production apparatus can also be changed by replacing the shaping belts for making taller or shorter hooks. The shaping belts may include multiple sub-belts, each of which may produce hook fasteners of differing shapes, sizes or characteristics for simultaneously producing different hook-fastener media in parallel flow relationship on one machine.

Thus, the hook characteristics can advantageously be adjusted over a wide range for providing different types and shapes of hooks on different types of substrate material of any reasonable, desired width. The substrate material may be woven or non-woven and may comprise more than one layer and may include metal or plastic or layers of both.

The substrate can be slit longitudinally after the hooks have been bonded onto the substrate, for producing several tapes simultaneously at a relatively fast overall lineal production speed, as compared with known woven or molding equipment as described above.

In addition, the present invention holds the promise, we believe, of fast and low-cost production. Consequently the hook-fastener media of this invention with their various sizes and shapes and various widths and characteristics, hold the promise of becoming widely available, widely used, relatively low cost, commodity-type products which will find their way into myriads of new applications of benefit to human beings in the years to come.

In accordance with the invention, many rows of hooks are formed, each row from a strand of plastic material, for example, preferably from a monofilament of longitudinally oriented polymeric material. The strand is formed and then "set" into its multiple hook row configuration in a high-speed operation separate from the substrate. Then these rows of pre-formed multiple hooks are bonded onto the substrate.

In production, many strands are fed in spaced parallel relationship to be formed and then "set" at high speed into many rows of pre-formed hooks. Then these pre-formed rows of hooks are all bonded onto a substrate layer for achieving a lineal production rate which is several times faster than in a needle loom. The various strands can be of different predetermined colors, if desired. Since the substrate may be a foot wide, or more, and since it can be slit longitudinally after the hooks have been bonded to it, the actual lineal production rate of hook-fastener tape one-inch wide embodying this invention can be twenty to fifty times faster, or more, than in a needle loom as used today. Also, the various slit tapes can have hook features of respective different colors.

In accordance with the present invention in one of its aspects, there is produced a multiple-hook fastener medium for providing hook-like gripping engagement with an opposed loop medium containing multiple accessible apertures into which the multiple hooks can become engaged by bringing the hook-fastener medium into contact with the opposed loop medium comprising a substrate area, a plurality of spaced parallel rows of multiple hooks mounted on the substrate area with said rows extending longitudinally along the substrate area, each row including a first plurality of identical, spaced, aligned left hooks facing outwardly from the left lateral side of the row, and each row also including a second plurality of identical, spaced, aligned right hooks facing outwardly from the right lateral side of the row. All of the left and right hooks of the first and second pluralities of hooks in each row are formed from a respective strand of bendable and settable polymeric plastic material, with the respective strand extending back and forth in zig-zag manner between the respective successive left and right hooks of each row, and with the zig-zag extending portions of each strand being bonded to the substrate area.

In accordance with the present invention in another of its aspects, an advantageous relatively low-cost, high production rate apparatus is provided for making hook fastener media of improved and variable characteristics and sizes. Many strands of bendable,settable polymeric material are fed in spaced parallel relationship into a first shaping zone between the interdigitating (meshing) teeth of a pair of opposed forming belts for bending and setting each of the strands into an intermediate zig-zag configuration by heat-softening the strands during bending and then cooling them to "set" the shape. These intermediate zig-zag strands are then fed into a second shaping zone between the interdigitating teeth of a second pair of opposed forming belts for bending and setting the tip portions of the respective zigs and zags of each strand into left-facing and right-facing hooks arranged in a row, with the shank portion of each hook having two legs. Then, the zig-zag extending portions of each row of hooks are bonded to a substrate, for example, by ultrasonic welding for completing the hook fastener.

By virtue of the zig-zag configuration of the intermediate strands, the concentration or density of the hooks are adjusted during production by adjusting the pitch of the respective zigs and zags.

Also, by virtue of the fact that the tip of each hook is a tightly formed U-bend in the strand, there is bulging of the polymeric material in the bight of the bend which acts somewhat like a rounded, slight barb on a fish hook for strengthening the hook-like gripping engagement with the loop medium.

As indicated previously, the configuration of the two legs of each hook is adjusted for ob taining a variety of hook characteristics, with crossed legs, uncrossed legs or divergent legs.

BRIEF DESCRIPTION OF THE DRAWINGS

The foregoing and other aspects, objects, features and advantages of the invention will become more fully understood from the following description of a preferred embodiment of the invention, as illustrated in the accompanying drawings, in which like reference characters refer to the same parts throughout the different views. The drawings are not necessarily to scale, emphasis instead being placed upon illustrating the principles of the invention.

FIG. 5A is an enlarged perspective view of one of the guide passageways seen in FIG. 5.

FIG. 5B is an enlarged sectional view of the second pair of forming belts.

FIG. 5C illustrates the pre-formed hooks being bonded to the backing material.

Returning attention to FIGS. 2 and 4, the relative height of the protruding hooks in the "Z" dimension is changed by using a different pair of interdigitating forming belts in the second set of zones. The overall size of the zigs and zags is changed by using a different pair of interdigitating belts in the first set of zones.

Figure 1:
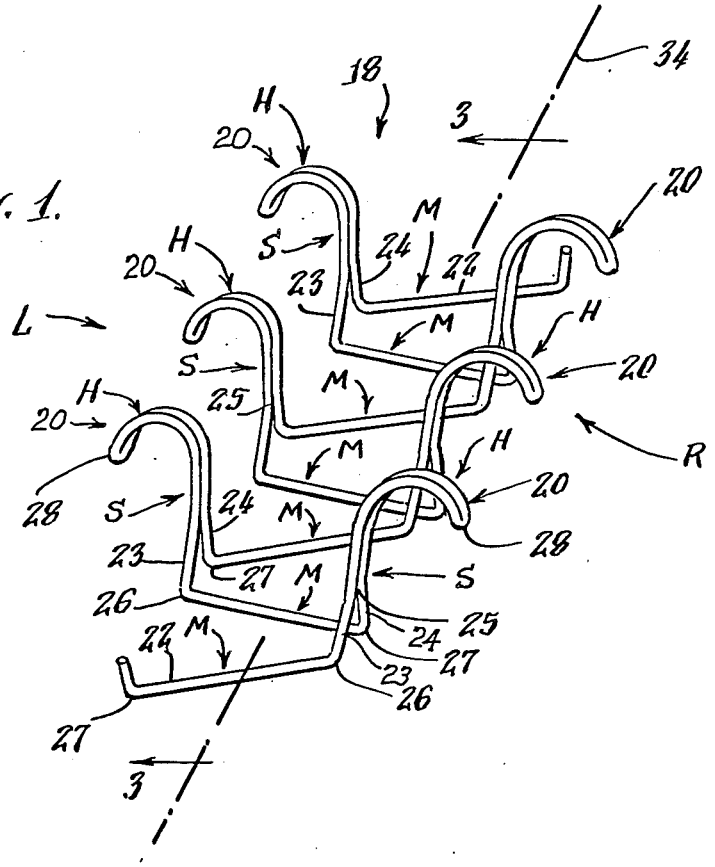
FIG. 1 is a greatly enlarged perspective view of a row of left-facing and right-facing hooks formed from a strand of bendable and settable polymeric material in accordance with this invention.

Inviting attention to the drawings in greater detail, FIG. 1 shows a row 18 of identical hooks 20, formed from a strand 22, with left-facing and right-facing hooks in the lateral regions L and R, respectively, of the row 18. Each hook 20 includes a curved arch-shaped head portion H, with a shank portion S extending between the head portion and a mounting portion M which extends between the respective left-facing and right-facing hooks. The shank portions of each hook include two legs 23 and 24 formed from a pair of respective segments of the strand 22.

The strand 22 is a monofilament of polymeric plastic material which is stiffly flexible at room temperature and which becomes limply bendable at a suitably elevated temperature. For example, this polymeric plastic material in the monofilament strand 22 may advantageously be Nylon polyamide.

The legs 23 and 24 converge upwardly and meet at a point 25 approximately one-half of the way up the shank S. Starting at the near end of the row 18, in FIG. 1, the strand 22 is seen to run from a bend 27 toward the right, defining a first mounting portion M. Then the strand bends up abruptly at a foot bend 26 commencing the leg portion 23. Continuing up this leg portion 23, the strand is seen to converge toward the other leg 24, meeting with it at point 25. The strand then continues up the shank S from the meeting point 25 closely adjacent and parallel to the other leg and continues into the head portion H, arching up and over, continuing to the tip of the hook at 28.

At the tip 28, the strand bends back upon itself in a sharp, closely doubled-back U-bend, and the strand then again arches up and over parallel to itself through the head H continuing down through the shank S again to the point 25. Continuing down from point 25 the strand is seen in leg 24 to diverge from leg 23 until the strand reaches the other foot bend 27. From this foot bend 27 the strand is seen to run toward the left, defining a second mounting portion M. The strand then bends up abruptly at another foot bend 26 leading to the leg 23 of a left-facing hook 20, and continuing so forth, back and forth along the row 18.

Looking at the mounting portions M of the strand 22 in the row 18, the strand is seen to zig-zag back and forth as it extends from a foot bend 27 of one outwardly facing hook to the foot bend 26 of the next sequential hook, which faces laterally outwardly in the opposite direction from the previous hook. Thus the strand continues to zig-zag back and forth forming the row 18 hooks 20.

Figure 2:
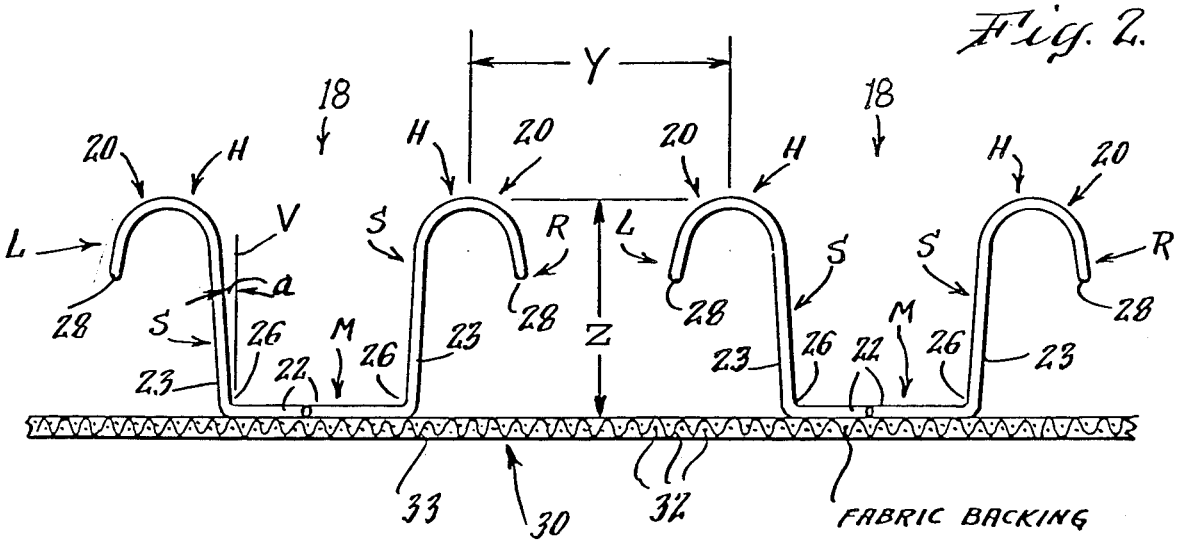
FIG. 2 is a further enlarged cross-sectional view showing two rows of these hooks bonded onto the substrate.

As shown in FIG. 2, the mounting portions M of the respective rows 18 of hooks 20 are bonded to a backing material 30, which may be called a substrate, for holding the rows 18 of hooks 20 which protrude to a height Z above the upper surface of this substrate 30. This substrate 30 may comprise any suitable layer or layers of woven or non-woven material. In FIG. 2, the substrate 30 is shown as a woven fabric material 33.

The mounting portions M can be bonded to the backing 30 by any suitable settable adhesive. However, in this preferred embodiment of FIGS. 1, 2 and 3, the bonding is achieved by ultrasonic welding. A strong, neat ultrasonic weld can be achieved between two Nylon polymeric materials. Consequently, when using a woven substrate, the threads 32 which are woven into the fabric 33 include a relatively large percentage of suitable ultrasonic bondable Nylon polymeric material. When using a non-woven substrate, it may be precoated with a suitable ultrasonic bondable coating.

Figure 3:
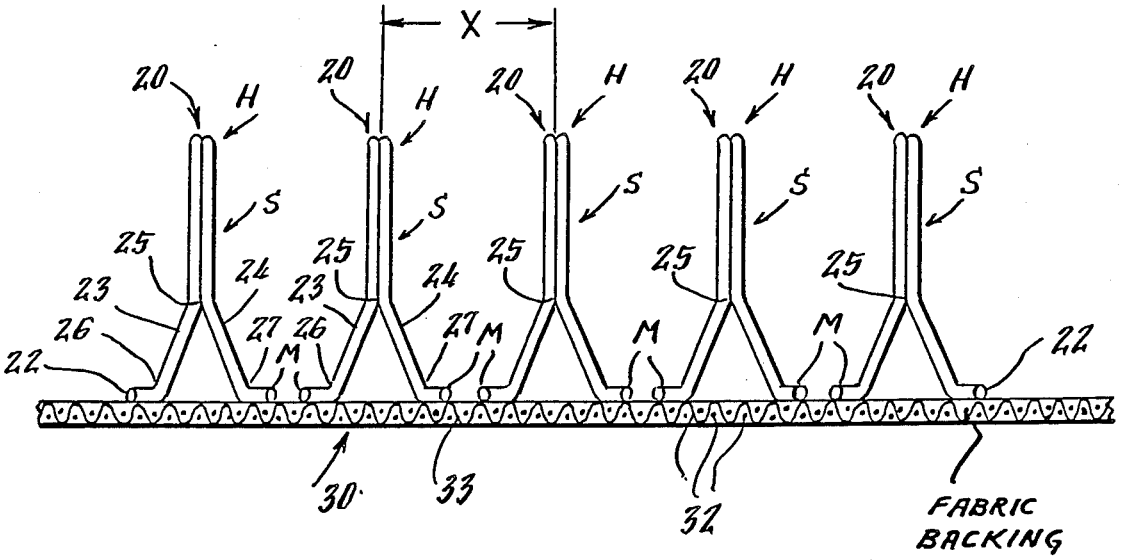
FIG. 3 is a vertical sectional view taken along the line 3—3 in FIG. 1, looking toward the left.

In FIG. 3, the upwardly converging legs 23 and 24 are most clearly seen meeting at the point 25. This view is a section taken along the center line 34 (FIG. 1) of the row 18 looking toward the left. Each hook 20 in FIG. 3 is seen to have an inverted Y-shape.

Figure 4:
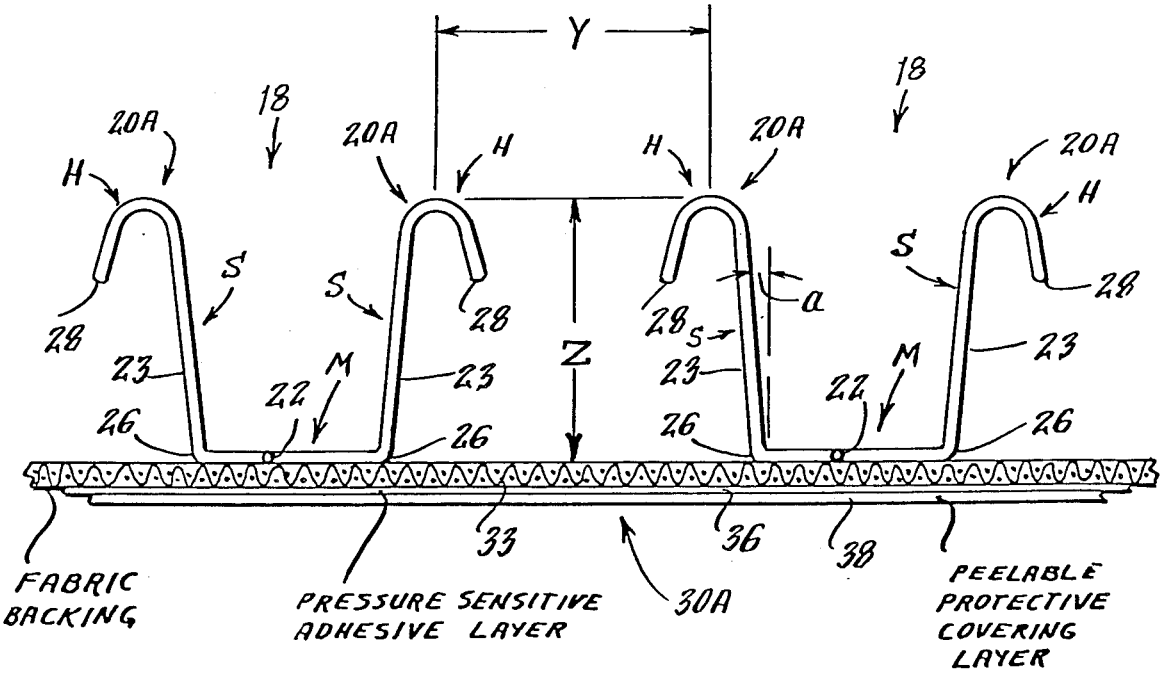
FIG. 4 is a view similar to FIG. 2 showing two rows of hooks bonded onto a substrate. The substrate has different characteristics from the one shown in FIG. 2, and the hooks have a different shape.

A comparison of FIG. 4 with FIG. 2 will begin to give an appreciation of the large variety and variations of hook configurations which can be readily and conveniently fabricated in the hook media in accord with this invention. In the embodiment of FIG. 4, the hooks 20A in each row 18 have a different shape from the hooks 20 in FIG. 2, and the substrate 30A is different from the substrate 30. For example, this substrate 30A includes a fabric layer 33 plus a lower layer 36 of pressure-sensitive adhesive with a peelable sheet 38 covering and protecting the adhesive 36. In use, the protective sheet 38 is peeled off from the pressure-sensitive adhesive 36 for exposing this adhesive, so that the fabric substrate 30A can be adhered to any area desired to be fastenable by the rows 18 of hooks 20A.

It is noted that the head portions H of the hooks 20A in FIG. 4 are smaller than the head portions H of the hooks 20 in FIG. 2. The shank S of the hooks 20A are longer, and these shanks diverge upwardly at a somewhat wider angle than in FIG. 2. For example, in FIG. 2 each shank S inclines outwardly from a vertical line V at an angle "a" of less than 4°. In FIG. 4, each shank S inclines outwardly from a vertical line V at a predetermined fixed angle "a" in the range from 3° to 9°.

Also, in FIG. 4, the rows 18 are spaced laterally farther apart than are the rows 18 in FIG. 2. The smaller head hooks of FIG. 4 more readily enter into the apertures of the loop medium, and the wider spacing of the rows facilitates the entry of each hook into the apertures of the loop medium. Consequently, it is relatively easy to achieve a hooking engagement with hooks of the small head configuration of FIG. 4. Only very light and quick contact pressure against the loop medium is sufficient to achieve hooking engagement.

However, the smaller head hooks of FIG. 4 will engage fewer fibers of the loop medium, and hence the fastening engagement is less inclusive of the loop medium than occurs with the embodiment of FIG. 2.

Figure 5:
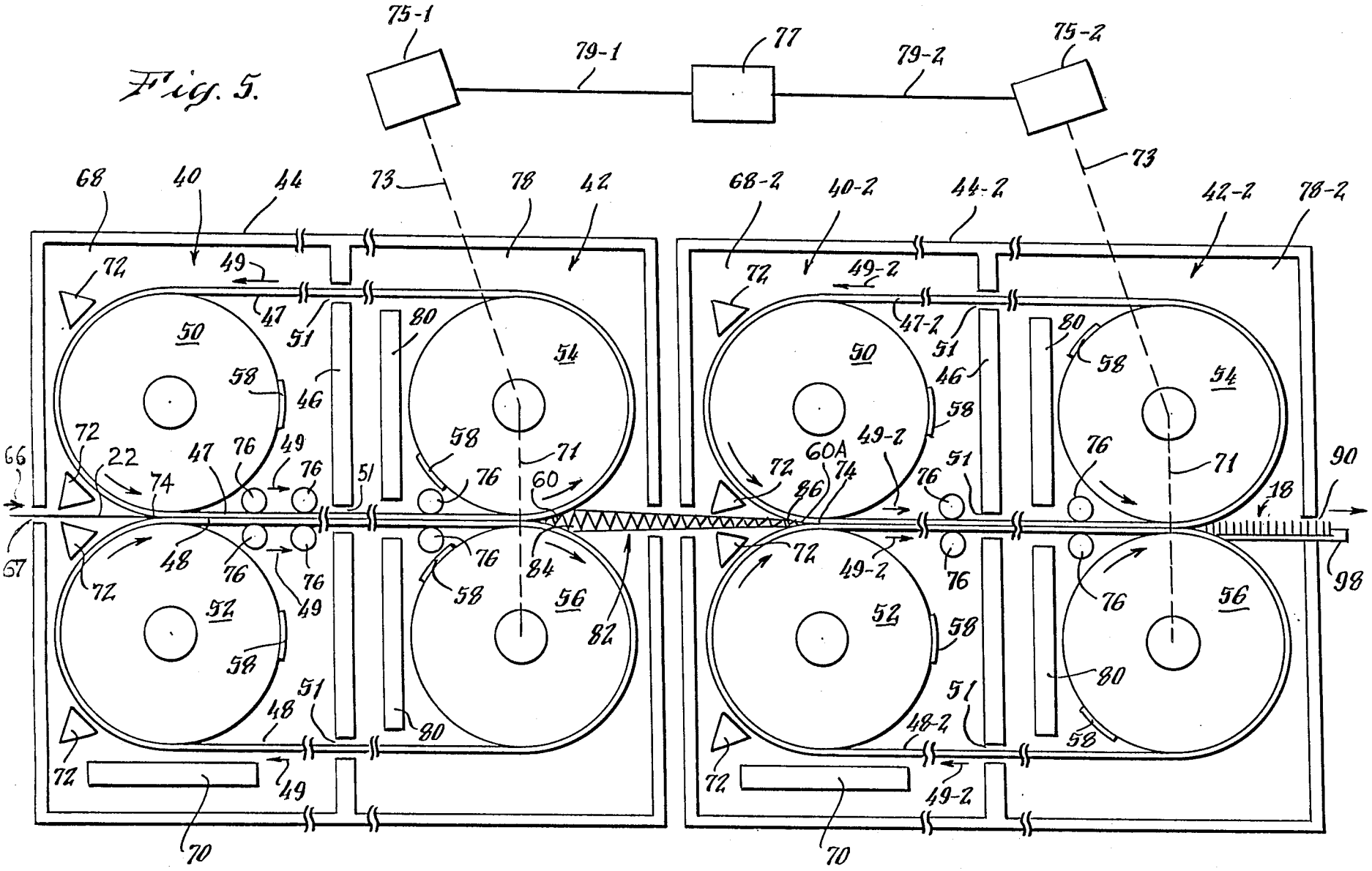
FIG. 5 is a schematic diagram of the production apparatus embodying this invention, including a first and second set of shaping and setting zones.

In the production apparatus, as shown in FIG. 5, there is a first shaping zone 40 and a first setting zone 42, both located within the same thermally insulated housing 44. A thermally insulated vertical partition 46 within this housing separates the shaping zone 40 from the setting zone 42. A pair of endless flexible, meshing, shaping belts 47 and 48 revolve in synchronism in opposite directions, as shown by the arrows 49. The upper shaping belt 47 is revolving counterclockwise and the lower shaping belt 48 clockwise, passing through respective narrow horizontally elongated ports 51 in the partition 46. The upper belt 47 revolves around input and output rollers 50 and 54, respectively, while the lower belt 48 revolves around input and output rollers 52 and 56, For facilitating the manufacture and maintenance of the shaping belts 47 and 48, they each comprise a plurality of narrower sub-belts. For example, each sub-belt is three inches wide, and four of them are assembled together in parallel edge-to-edge relationship on their respective rollers for providing a shaping belt 47 or 48 having an overall width of approximately twelve inches. For guiding each of these sub-belts and keeping them tracking together in parallel relationship, rollers 50, 52, 54 and 56 each has a plurality of narrow circumferentially extending pulley-type peripheral flanges, as indicated partially at 58, and these narrow guiding flanges 58 are spaced apart three inches for straddling the sub-belts.

If wider shaping belts 47 and 48 are desired for further increasing the production rate of the hook medium, then longer rollers 50, 52, 54 and 56 are provided having more of these pulley-type flanges, and more of the narrow sub-belts are utilized for providing shaping belts 47 and 48 which are two feet wide or a yard wide, and so forth.

The widths of these two shaping belts 47 and 48 in any particular installation are always the same, because they work in opposition to each other. The belts 47 and 48 are preferably made of stainless steel. The front surfaces (outer surfaces) of the respective belts 47 and 48 include multiplicities of parallel, axially extending and circumferentially spaced teeth 61 and 62, respectively, as shown greatly enlarged in FIG. 6 for shaping and setting the strand 22 into the intermediate corrugated configuration 60. This initial corrugated configuration 60 includes sharp peaks 63 and sharp valleys (inverted peaks) 64 with sloping shoulders 65 interconnecting these peaks and valleys. In other words, the strand 22 is bent back and forth zig-zag fashion 60 in a vertical plane on opposite sides of a centerline 59 (FIG. 5A) with equal size sharp U-bend peaks 63, 64 facing in opposite direction from said centerline.

It will be seen that the peaks and valleys 63 and 64 of this intermediate corrugation 60 will subsequently become shaped into the tips 28 (FIGS. 1–4) and head and shank portions H and S of the respective left-facing and right-facing hooks 20 or 20A in a row 18. The sloping shoulder 65 will become shaped into the diverging legs 23 and 24 and into the zig-zag mounting portions M.

A relatively large number of the strands 22 (only one is seen) are simultaneously fed in closely spaced parallel relationship through an entrance port 67. This entrance port 67 is as wide as the belts 47, 48 but is narrow in its vertical dimension. These multiple entering strands 22 are travelling toward the shaping zone 40 (FIG. 5) as shown by the arrow 66. In order to shape these entering strands 66, 22 into the intermediate corrugated shape 60, a first chamber 68 in the housing 44 in which the zone 40 is located, is heated by means of a gas or other heater 70 to a temperature slightly above the softening temperature of the monofilament polymeric material of the entering strands 66, 22. For example, in the case of Nylon polymer, this heater 70 is adjusted to heat the chamber 68 t a suitable temperature level. A sequence of radiant heaters 72 are aimed at the front surfaces of the two revolving belts as they travel around the respective input rollers 50 and 52 just prior to their reaching the nip region 74 between these two rollers 50 and 52. These radiant heaters 72 may locally elevate the temperature of the teeth 61, 62 (FIG. 6) slightly above the average temperature in the chamber 68, if desired for enhancing the plastic softening action near the relatively sharp peaks and valleys 63, 64.

Figure 6:
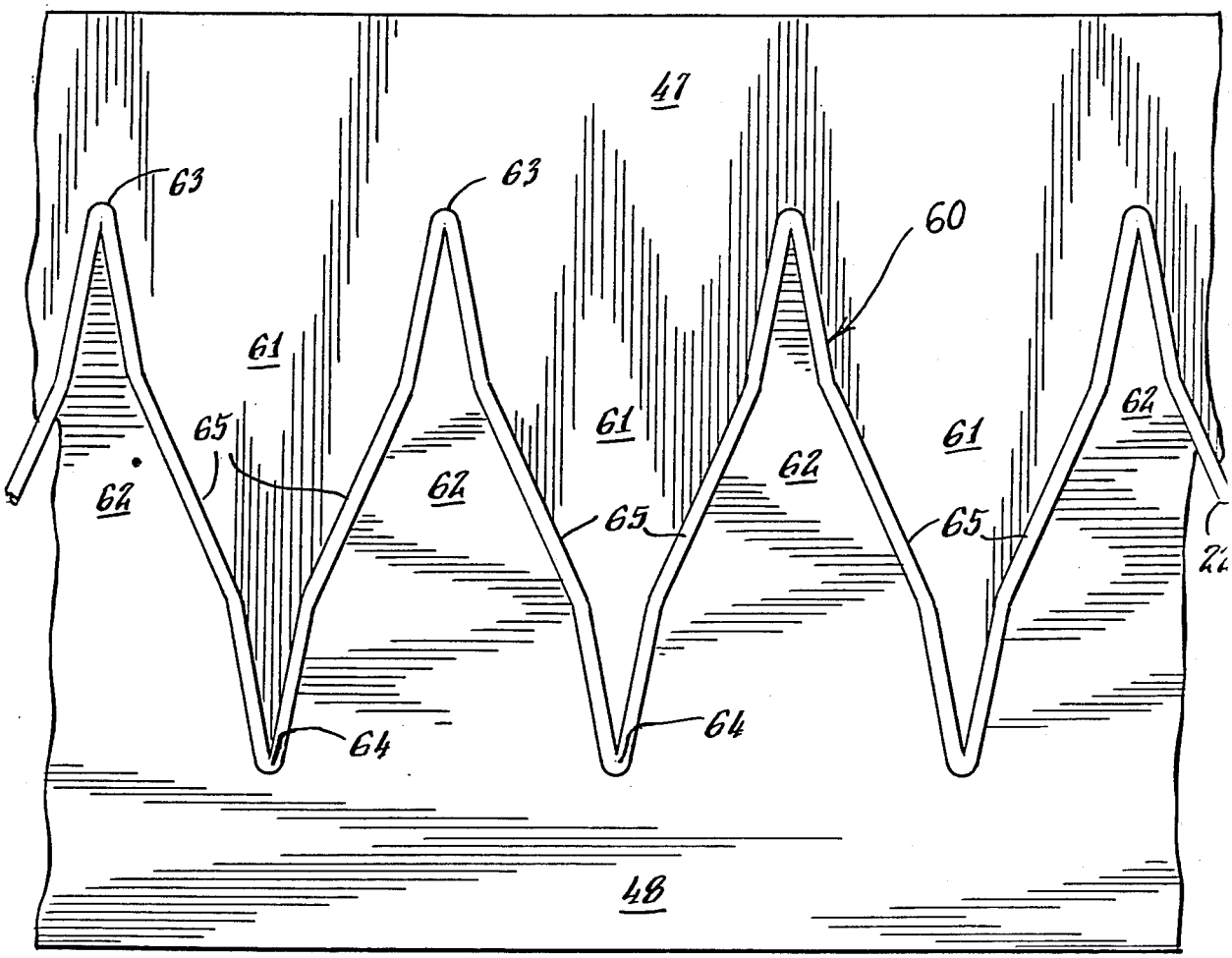
FIG. 6 shows the initial zig-zag configuration of one of the strands before and after it issues from the first shaping and setting zones and prior to its entry into the second shaping and setting zones.

In the nip region 74 these teeth 61, 62 mesh in interdigitated relation with the multiple strands becoming corrugated between them as seen in FIG. 6. The diameter of the rollers 50 and 52 is sufficiently large relative to the thickness of the stainless steel belts 47, 48 and relative to the pitch of their teeth 61, 62, that these belts will flex around these rollers at stresses well below their yield point. Thus, the teeth become mesh degradually without interference between them and with the entering strands 66, 22 captured between them as the belts move into the nip region 74, thereby corrugating the strands.

A plurality of smaller diameter rollers 76 extending transversely and engaging the rear (inside) surfaces of the belts 47 and 48 support and guide these meshed belts as they travel downstream from the nip region 74. The intermeshing of the heated teeth 61, 62 with the many parallel strands 66, 22 between them shapes these strands into the corrugated configuration 60 (FIG. 6).

In order to "set" this corrugated configuration 60, the meshed belt travel downstream through the narrow port 51 in partition 46 and enter a cooling chamber 78 in which the setting zone 42 is located for cooling them to a stable, lower temperature. Thus the strands become set into their intermediate corrugated shape 60. In this zone 42 the belts are cooled down to a suitable temperature by means of coolers 80 containing cooling fans blowing onto the per surfaces of the meshed belts. Also, the output rollers 54 and 56 are hollow and are cooled by circulating cold water through them.

The output rollers 54 and 56 are ganged together for rotation at the same peripheral speed in opposite directions by a mechanical interconnection 71, for example, by a gear train or by sprockets and a timing chain. These two rollers 54, 56 are driven through a transmission 73 by a controllable speed drive motor 75-1. The speed of the drive means 75-1 is under control of a control station 77 which is electrically connected to the drive means 75-1 through an electrical cable 79-1.

As each corrugated strand 60 exits from between the first pair of belts 47, 48, it is captured in a guide passageway 82 (please see FIG. 5A). This guide passageway 82 has a tall narrow rectangular configuration at its entry 84, and it gradually twits 90° in a helical path as seen enlarged in FIG. 5A into a wide narrow horizontal rectangular configuration at its exit 86. The purpose of each guide passageway 82 is to change the orientation of the plane of the corrugated strand 60 passing through it from vertical to horizontal.

The guide passageways 82 (FIG. 5) extend in parallel relationship from the thermally insulated housing 44 into a second similar housing 44-2 containing a second pair of revolving heated and cooled endless flexible shaping belts 47-2 and 48-2 revolving in synchronism in opposite directions through a second shaping zone 40-2 and a second setting zone 42-2.

Figure 7:
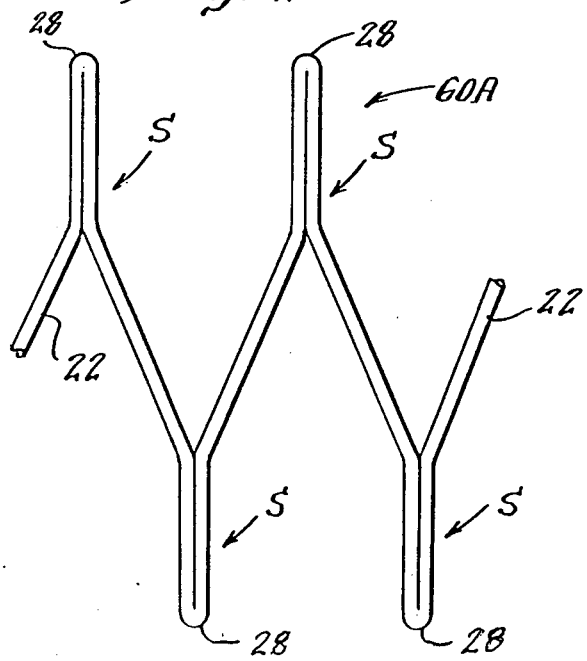
FIG. 7 shows the final zig-zag configuration of the strand of FIG. 6 after the pitch of the zigs and zags has been adjusted just prior to entry into the second set of zones. Thus, by changing the relative rates of lineal feed as between the first and second set of zones, the pitch of the zigs and zags in the intermediate strands is adjusted for varying the concentration or density of the hooks in the longitudinal direction "X" of the hook-fastener medium. In other words, changes in hook density in the longitudinal "X" dimension are conveniently made during production by adjusting the relative lineal speeds as between a first set and a second set of shaping and setting zones.

In order to cause the portions of strand 22 forming the peaks 63 and valleys 64 of the corrugated strand 60 (FIG. 6) to close into adjacent relationship, as shown in the partially closed corrugated configuration 60A in FIG. 7, ready for use in fabricating the tips 28 and shanks S of the hooks 20 or 20A, the second pair of shaping and setting belts 47-2 and 48-2 (FIG. 5) are moved at a slower lineal speed than the first pair 47, 48. The controllable-speed drive motor 75-2 for the second pair of belts is connected through an electrical cable 79-2 to the control station 77. Thus, the operator uses speed controls in the station 77 for setting the lineal speed of the second pair of belts 47-2, 48-2 relative to the lineal speed of the first pair of belts 47, 48 for producing the partially closed corrugated configuration 60A (FIG. 7) of the strand 22 which enters into the nip region 74 (FIG. 5) between the second pair of belts.

In order to facilitate the fabrication of the sharp U-bends 28, during the partial closing of the corrugations during the transition from 60 to 60A in the guide 82, a pair of elongated electrical heater strips 88 (FIG. 5A) may be extended along the two narrow edges of this helical guide passageway 82 for softening the strand 22 at the tips 28 for producing these sharp bends.

The second pair of belts 47-2, 48-2 convert each horizontally oriented, partially closed corrugated configuration 60A into a row 18 of hooks 20 or 20A, as shown in FIGS. 1, 2 and 4. These rows 18 of hooks (only one is in FIG. 5) issue at the right from the second housing 44-2 through an exit opening 90.

As shown greatly enlarged in partial cross section in FIG. 5B, the front (outer) face of the lower belt 48-2 includes a plurality of laterally spaced, longitudinally extending parallel grooves 92 with a longitudinally extending double hump 93, 94 between successive grooves. On the other hand, the front face of the upper belt 47-2 includes a plurality of laterally spaced, longitudinally extending parallel ridges 95 with a longitudinally extending double groove 96, 97 between successive ridges. These two belts mesh together as shown in FIG. 5B with sufficient clearance between them for the corrugated configuration 60A strands 22 to become sandwiched between them for final shaping in the second shaping zone 40-2 located in the second shaping chamber 68-2. Then the rows 18 of heat-softened hooks 20 or 20A are "set" by cooling of the belts in the second setting zone 42-2 located within the second setting chamber 78-2.

The rows 18 of hooks are carried out through the exit 90 (FIG. 5) by a plurality of substantially parallel channel-shaped guides or chutes 98 leading the rows 18 of hooks into the bonding zone 100 (FIG. 5C) where the mounting portions M of these rows re bonded by welding onto any compatible substrate 30 or 30A or 30B as may be desired. These guides 98 are described as being substantially parallel, because they can be laterally adjusted in the region 102 for converging or diverging the rows 18 for producing hook media 104 having, respectively, increased or decreased densities of hooks, i.e., more or less hooks per square inch. By converging the channel guide 98, the rows 18 become more closely spaced in the lateral "Y" direction (FIGS. 2 and 4) and vice versa.

The substrate 30 or 30A or 30B is supplied from a roll 106 and passes over a guide roller 108 and then passes above an anvil roller 110 having an extremely hart durable surface, for example, a steel roller having a deep case-hardened nitrided surface. In opposed relationship to this anvil roller 110 are a plurality of ultrasonic welding probes 112 (only one is seen) each having a tapered horn shape having many tips and being ultrasonically vibrated y a driver 114. There is one of these welding horn tips 112 extending down into the region between the left-facing and right-facing hooks of each row 18 engaging the mounting portions M and welding them onto the substrate 30 or 30A or 30B.

If desired, the ultrasonic welding unit 114 may be place below the substrate 30, 30A or 30B. For example, such a welding unit may include a vibrationally driven bar extending transversal across below the substrate. This ultrasonically vibrating bar extends transversely with respect to the direction of motion of the substrate and the rows of hooks 18. A plurality of hardened anvil disc wheels are located above the rows of hooks 18 opposite the ultrasonic bar. The extremely hard, durable rims of these disc wheels serve as anvils, and they roll over the mounting portions M (FIGS. 1, 2, 4, 10) of the respective rows of hooks for ultrasonically welding these mounting portions onto the substrate. The ultrasonic bar may have a smooth surface, or it may have a pattern of ridges or small bumps for concentrating the welding action at various localized regions with respect to each mounting portion M.

If desired, for providing additional capture and additional bonding strength, an additional strip of bonding material may be applied downstream of the bor staton 100 (FIG. 5C) the region between the row of left-facing hooks L and the row of right-facing hooks R. In other words, this additional strip is fed parallel to the centerline 34 over respective mounting portions M (FIG. 1) This strip is bonded to the backing for aiding in securing the mounting portions M to the backing (substrate).

This strip may be ultrasonically weldable or heat sealable or coated with pressure-sensitive adhesive of the permanent variety. There may be employed a second bonding station located downstream from the first bonding station for producing bonding or supplemental bonding of this additional strip.

When the channel guides 98 are laterally adjusted for changing the density of hooks in the hook medium 104, other comb-shaped welding horns 112 (with appropriately, differently spaced teeth) are correspondingly substituted for maintaining alignment directly above the mounting portions M of each retive row 18 of hooks.

The hardened surface of the anvil roller 110 may have any desired pattern of ridges and depressions for concentrating the ultrasonic welding action into a particular pattern for increasing the flexiblity f the resultant welded hook medium 104. For example, there ay be a checkerboard or diamond pattern, or lattice pattern, of ridges and depressions.

Figure 10:
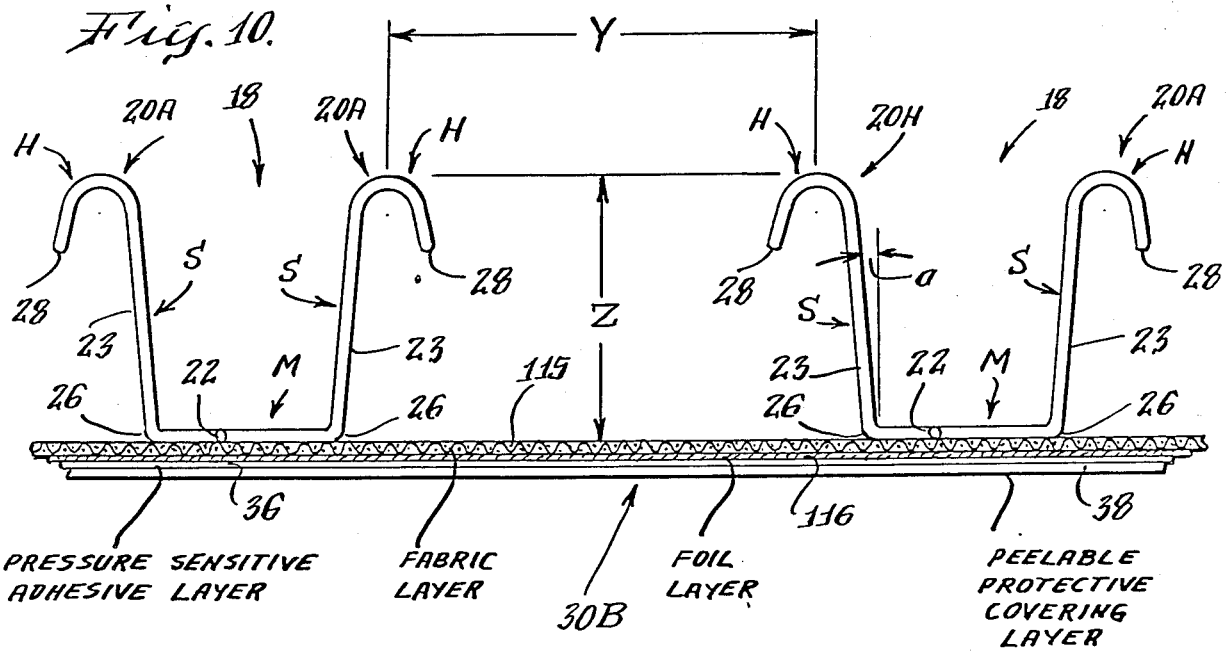
FIG. 10, compared with FIGS. 2 and 4, shows how changes in the hook density in the lateral "Y" dimension are conveniently made during production by adjusting the lateral spacing of the guide feed channels between the first and second set of zones.

As indicated previously, the longitudinal spacing of the hooks in the "X" direction (FIGS. 3, 5A and 5C) is accomplished by using the control station 77 (FIG. 5) for adjusting the relative speeds of the two sets of belts. The resultant changes in lateral "Y" direction are seen, for example, by comparing FIG. 10 with FIGS. 2 and 4. Also, FIG. 10 shows a hook medium in which the substrate 30B includes an upper Nylon layer 115 bonded to a metal foil layer 116, for example, aluminum foil, having a pressure-sensitive adhesive layer 36 and a peelable protective covering sheet 38.

Figure 8:
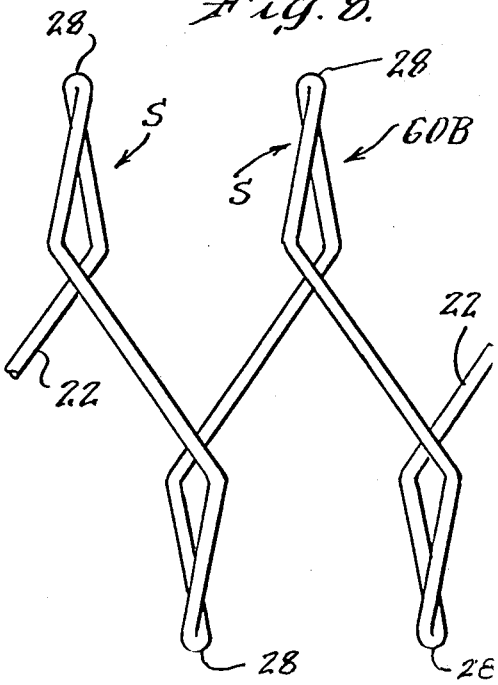
FIG. 8 shows that by appropriate adjustments in relative feed rates the two legs in the shanks of each hook can be crossed.
Figure 9:
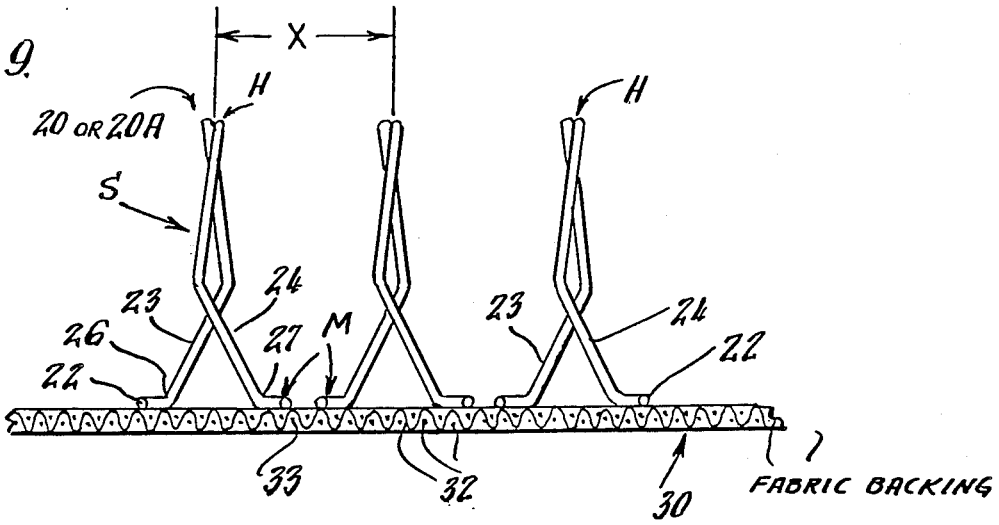
FIG. 9 is a view similar to FIG. 3 showing the resultant hook configuration with crossed legs.

In order to produce hooks in which the legs in the shanks of each hook are crossed,as shown in the corrugated configuration 60B in FIG. 8 and in the cross section of a row of hooks in FIG. 9, the difference between the relative lineal rates 49 and 49-2 (FIG. 5) is increased.

Figure 11A:
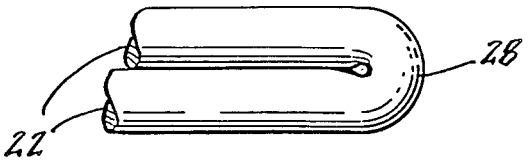
FIGS. 11A and 11B show a greatly enlarged plan view and side view, respectively, of the U-bent tip portion of a hook.
Figure 11B:
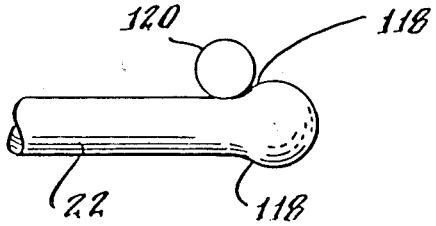

The present invention has the further advantage as shown in FIGS. 11A and 11B that the tip 28 of each hook is a tightly formed U-bend in the strand 22. Thus, there can be produced a bulging 118 of the polymeric material near the bight of the U-bend which acts somewhat like double barbs on a fish hook for strengthening the tiny hook-like gripping engagement with a loop or fiber 120 of the loop medium.

In order,to change the shape of the heads H of the hooks 20 or 20A, the second pair of belts 47-2 and 48-2 are changed to a pair having different front surface configurations as will be understood by comparing FIGS. 2, 4 and 5B.

For changing the overall size of the hooks, both pairs of belts 47, 48 and 47-2, 48-2 are changed.

Thus, it will be understood that the present invention is very flexible in application. For example, the subbelts comprising the respective pairs of belts 47, 48 and 47-2, 48-2 can be different on two sides of the apparatus and system shown in FIG. 5 for simultaneously producing two different kinds of hook media 104 (FIG. 5C). A slitting station 122 is included for slitting the hook medium 104 longitudinally into multiple strips, as may be desired.

Although the apparatus for producing the hook-fastening mm has been described as employing relatively wide belts 47, 48 and 47-2, 48-2 including multiple subbelts, the invention can also be embodied to advantage in an apparatus employing relatively narrow single belts 47, 48, 47-2 and 48-2, for example such single belts for producing hook-fastening media approximately one inch wide.

While the invention has been particularly shown and described with reference to preferred embodiments, it will be understood by those skilled in the art that various changes in form and details may be made without departing from the spirit and scope of the invention as defined by the appended claims and reasonable equivalents of the claimed elements.

We claim:

1. Apparatus for making a multiple-hook fastener medium capable of hook-like gripping engagement, comprising:

a first plurality of shaping teeth movable along a first endless path, a second plurality of shaping teeth movable along a second endless path meshing with said teeth of the first plurality along a predetermined portion of their respective paths, means for revolving said first and second plurality of shaping teeth along their respective endless paths for meshing them together along said portion of their respective paths, means for feeding at least one strand of bendable material between the meshing shaping teeth as they move along said portion of their respective paths for bending the strand back and forth zig-zag fashion on opposite sides of a centerline forming sharp U-bends facing in opposite directions from said centerline, bending means for bending the strand near at least some of said sharp U-bends for forming hooks with a sharp U-bend being located at the tip of each hook, and bonding means for bonding the strand to a backing with the hooks upstanding from the backing.

2. Apparatus for making a multiple-hook fastener medium as claimed in claim 1, in which said bending means comprises:

a first member having a first front face including a plurality of laterally spaced,longitudinally extending parallel grooves with a longitudinally extending double hump between successive grooves, a second member having a second front face meshable with said first front face including a plurality of laterally spaced longitudinally extending parallel ridges with a longitudinally extending double groove between successive ridges, means for causing said first and second members to mesh together with said parallel grooves of the first face receiving into themselves the respective parallel ridges of the second face and said double grooves of the second face receiving into themselves said double humps of the first face when said first and second members are meshed together, means for feeding a zig-zag bent strand between said meshable members as they mesh with the centerline of said zig-zag being aligned with and entering one of the grooves of said first face for forming mounting portions with upstanding shanks on either side of the mounting portions, and with the portions of the strand near the sharp U-bends on one side of the centerline being aligned with and bending over the adjacent hump of the double hump on one side of said one groove for forming curving hook heads facing outwardly from said centerline and with the portions of the strand near the sharp U-bends on the other side of the centerline being aligned with and bending over the adjacent hump of the double hump on the other side of said one groove for forming curving hook heads facing outwardly in the other direction from said centerline, and said bonding means bonds said mounting portions to the backing.

3. Apparatus for making a multiple-hook fastener medium as claimed in claim 2, in which:

said grooves each has a pair of approximately square corners as seen looking longitudinally along the grooves, said grooves have a pair of side walls, each wall extending upwardly from a respective one of said corners, and each wall diverges outwardly upwardly from a vertical line as seen looking longitudinally along the groove.

4. Apparatus for making a multiple-hook fastener medium as claimed in claim 3, in which:

each wall of the groove diverges outwardly upwardly from a vertical line "V" by an angle "a" of no more than 9°.

5. Apparatus for making a multiple-hook fastener medium as claimed in claim 1, in which said means for revolving said first plurality of shaping teeth and said second plurality of shaping teeth along their respective endless paths include:

first endless flexible belt operatively associated with said first plurality of shaping teeth, and a second endless flexible belt operatively associated with said second plurality of shaping teeth.

6. Apparatus for making a multiple-hook fastener medium as claimed in claim 5, in which said means for revolving said first and second plurality of shaping teeth along their respective endless paths include:

roll means engaging the respective inner surfaces of said first and second endless flexible belts, and drive means for rotating said roll means.

7. Apparatus for making a multiple-hook fastener medium as claimed in claim 2, in which:

said first member having said first front face includes a revolvable endless flexible belt with its front face on its outer surface, said second member having said second front face includes a revolvable endless flexible belt with its front face on its outer surface, and said means for causing said first and second members to mesh together includes a plurality of rolls for revolving said belts in opposite directions with a portion of each belt moving in closely spaced opposed relationship with a portion of the other belt.

8. Apparatus for making a multiple-hook fastener medium as claimed in claim 1, in which:

said strand includes bendable and settable material, said apparatus includes first setting means for setting said material while the strand is between the meshing teeth for retaining the zig-zag bent configuration of the strand when it is away from said teeth, and said apparatus includes second setting means for setting said material when the strand has been bent by said bending means for retaining said hooks when the strand is away from said bending means.

9. Apparatus for making a multiple-hook fastener medium as claimed in claim 8, in which:

said material is softened by heating and is set by cooling, said apparatus includes heating means for heating said shaping teeth prior to the feeding of the strand between them in their meshing relationship, said first setting means includes cooling means for cooling the meshing shaping teeth while the strand is between them in their meshing relationship, said apparatus includes heating means for heating the bending means prior to forming said hooks, and said second setting means includes cooling means for cooling the bending means when the strand has been bent into said hooks by said bending means.

10. Apparatus for making a multiple-hook fastener medium as claimed in claim 2, in which:

said strand includes bendable and settable material, said apparatus includes first setting means for setting said material while the strand is between the meshing teeth for retaining the zig-zag bent configuration of the strand when it is away from said teeth, and said apparatus includes second setting means for setting said material while the strand is between said first and second members for retaining said hooks when the strand is away from said members.

11. Apparatus for making a multiple-hook fastener medium as claimed in claim 10, in which:

said material is softened by heating and is set by cooling, said apparatus includes heating means for heating said shaping teeth prior to the feeding of the strand between them in their meshing relationship, said first setting means includes cooling means for cooling the meshing shaping teeth while the strand is between them in their meshing relationship, said apparatus includes heating means for heating the first and second members prior to forming said hooks, and said second setting means includes cooling means for cooling the first and second members while the strand is between them bent into said hooks by said members.

12. Apparatus for making a multiple-hook fastener medium as claimed in claim 1, in which:

said first plurality of shaping teeth have relatively sharp peaks for forming said sharp U-bends on one side of said centerline, said second plurality of shaping teeth have relatively sharp peaks for forming said sharp U-bends on the other side of said centerline, said first plurality of shaping teeth each has a pair of sloping shoulders spaced downwardly from their respective peaks, and said second plurality of shaping teeth each has a pair of sloping shoulders spaced downwardly from their respective peaks for meshing with the sloping shoulders of the teeth of said first plurality for forming sloping upwardly converging leg portions of each hook.

13. Apparatus for making a multiple-hook fastener medium capable of hook-like gripping engagement with an opposed area containing multiple accessible apertures into which the multiple hooks can become engaged by bringing said fastener medium into contact with said opposed area comprising:

first bending means for bending at least one strand of a bendable, settable material for forming a plurality of sharp U-bends positioned at spaced locations along the strand, first setting means for setting the bent material of said strand a first time for causing the strand to retain said sharp U-bends, second bending means for bending the strand near at least some of said sharp U-bends to form hooks with said sharp U-bends forming the tips of the hooks, second setting mean for setting material of said strand a second time for causing the strand to retain said hooks and bonding means for bonding the strand having said hooks to a backing with the hooks upstanding from the backing for forming the multiple-hook fastener medium.

14. Apparatus as claimed in claim 13, in which said first bending means includes:

means for bending the strand near at least some of said sharp U-bends to form pairs of sloping leg portions converging toward each other fro opposite sides, said first setting means serves for simultaneously setting the bends which define said sloping leg portions and said sharp U-bends, and said bonding means serves for bonding the strand having said hooks and pairs of converging leg portions to the backing with said pairs of leg portions upstanding from the backing and converging toward each other in pairs for supporting the respective hooks.

15. Apparatus as claimed in claim 13, including:

controllable drive means for crossing respective portions of the strand near at least some of the respective sharp U-bends prior to the forming of said hooks by said second bending means.

16. Apparatus as claimed in claim 13, in which:

said bendable, settable strand is softened by heating for bending and is cooled while bent for setting, said first bending means includes heating means for heating material of the strand during bending of said sharp said first setting means includes cooling means for cooling material of the strand while bent by said first bending means, said second bending means includes heating means for heating material of the strand during bending of said hooks, and said second setting means includes cooling means for cooling material of the strand while bent by said second bending means.

17. Apparatus as claimed in claim 13, in which:

said first bending means includes a first plurality of shaping teeth movable along an endless path and a second plurality of shaping teeth movable along a second endless path meshing with said teeth of the first plurality along a predetermined portion of their respective paths, drive means for moving said first and second plurality of shaping teeth along their respective endless paths for meshing them together along said portion of their respective paths, and means for introducing the sts between the meshing shaping teeth as they move along said portion of their respective paths for bending the strand back and forth zig-zag fashion on opposite sides of a centerline forming sharp U-bends facing in opposite directions from said centerline.

18. Apparatus as laimed in claim 13, in which:

said first bendrng means bends the strand back and forth zig-zag fashion on opposite sides of a centerline with the sharp U-bends projecting outwardly on left and right sides of th centerline, said second bending means forms the sharp U-bends and adjacent portions of the strand on the left side of the centerline into left-facing hooks having upstanding double shanks, each double shank including first and second shank portions of a strand extending respectively to and from the sharp U-bend located at the tip of the hook, said second bending means also forms the sharp U-bends and adjacent portions of the strand on the right side of the centerline into right-facing hooks having upstanding double shanks, each double shank including first and second shank portions of a strand extending respectively to and from the sharp U-bend located at the tip of the hook, said second bending means causes mounting portions of the strand near the centerline to extend zig-zag fashion back and forth across the centerline, said mounting portions interconnecting the respective lower end of a second shank portion of a left-facing hook with the lower end of a first shank portion of a right-facing hook and interconnecting the respective lower end of a second shank portion of a right-facing hook with the lower end of a first shank portion of a left-facing hook, and so forth along the strand, and said bonding means bonds said mounting portions of the strand to the backing.

19. Apparatus as claimed in claim 13, in which:

said first bending means forms sloping portions of the strand extending diagonally across the centerline, and said second bending means forms segments of said sloping portions of the strand into lower segments of the double shanks of the left-facing hooks and into lower segments of the double shanks of the right-facing hooks, said lower segments thus comprising upwardly converging sloping leg portions of the respective double shanks.

20. Apparatus for making a multiple-hook fastener medium capable of hook-like gripping engagement, comprising:

means for revolving a first plurality of first shaping teeth along a first endless path, means for revolving a second plurality of second shaping teeth along a second endless path meshing with the first teeth along a predetermined portion of their respective paths, means for introducing at least one strand of bendable material between the first and second shaping teeth as they mesh along said portion of their respective paths for bending the strand back and forth zig-zag fashion extending on opposite sides of a centerline forming sharp U-bends projecting outwardly in opposite directions from said centerline, means for revolving a first hook-forming member along a first endless flexible path, said first member having a pair of spaced, parallel, longitudinally extending rounded humps with a groove therebetween, means for revolving a second hook-forming member along a second endless flexible path, said second member having a longitudinally extending ridge with a pair of spaced, parallel, longitudinally extending rounded channels positioned respectively on opposite sides of said ridge, said ridge of said second member entering into said groove of the first member and said humps of the first member entering into the respective channels as said members move along a predetermined portion of their respective paths, means for introducing the zig-zag bent strand between said members as they move along said portion of their respective paths with the centerline of the zig-zag passing into the center of said groove and with the outwardly projecting U-bends bending over the respective rounded humps forming a double row of upstanding hooks facing outwardly in opposite directions from said centerline, and bonding means for bonding intermediate portions of the strand between said double row to a backing.

21. Apparatus for making a multiple-hook fastener medium as claimed in claim 20, including:

first setting means for setting the strand between the meshing first and second teeth for retaining the zig-zag bent configuration of the strand when it is away from said teeth, and second setting means for setting the strand bent between said hook-forming members for retaining said hooks when the strand is away from said members.

22. Apparatus for making a multiple-hook fastener medium as claimed in claim 21, in which:

said strand is softenable by heating during bending and is settable by cooling after bending, said apparatus includes heating means for heating said first and second shaping teeth prior to introduction of the strand between them, said first setting means includes cooling means for cooling the meshing first and second teeth for setting the zig-zag bent configuration of the strand held between them, said apparatus includes heating means for heating said first and second hook-forming members prior to introduction of the zig-zag bent strand between them, and said second setting means includes cooling means for cooling the first and second members while the strand is held bent between them for setting said upstanding hooks.

* * * * *